United States Patent [19]

Parker

[11] Patent Number: 4,487,572

[45] Date of Patent: Dec. 11, 1984

[54] FIREPLACE FIRE STARTER

[76] Inventor: Ronald G. Parker, Box 12, #3 Susie Circle, Electra, Tex. 76360

[21] Appl. No.: 78,062

[22] Filed: Sep. 24, 1979

[51] Int. Cl.[3] ..... F23D 5/02

[52] U.S. Cl. ..... 431/331; 131/298; 126/25 B

[58] Field of Search ..... 431/320, 321, 322, 323–326, 431/315–319, 341, 331, 298; 44/35, 38, 41; 126/25 B

[56] References Cited

U.S. PATENT DOCUMENTS

| | | | |
|---|---|---|---|
| 282,883 | 8/1883 | Gschwendner | 431/327 |
| 530,716 | 12/1894 | Dearson | 431/327 |
| 1,029,757 | 6/1912 | Jeavons | 431/341 |
| 1,057,128 | 3/1913 | Dolley | 431/320 |
| 1,446,353 | 2/1923 | Slocum | 431/341 |
| 1,461,496 | 7/1923 | Quist | 431/298 |
| 2,306,467 | 12/1942 | Reynolds | 431/331 |
| 4,000,732 | 1/1977 | White | 44/38 |

*Primary Examiner*—Carroll B. Dority, Jr.
*Attorney, Agent, or Firm*—Thomas L. Cantrell; Stanley R. Moore; Warren B. Kice

[57] ABSTRACT

Disclosed is an apparatus for safely and effectively facilitating the ignition of logs positioned on a grate within a fireplace. It includes an elongated open top container and a base for support. The open top of the container maintains a flame sustained by the combustion of vaporized fuel. Once combustion of the fuel is initiated, the container walls defining this opening receive and conduct heat to the fuel reservoir to vaporize more fuel and thereby sustain combustion. Combustion may be initiated by a combustible wick. The upper section of the windward wall of the container slopes downwardly and outwardly from the opening at the top of the container and this surface cooperates with the surface formed by the bottom of the grate and its contents. Together, these surfaces restrict the natural draft underneath the grate producing somewhat of a venturi effect thereby increasing the velocity of the draft. Under the venturi influence, the draft trails the flame maintained at the top of the container beneath a greater depth of logs than it would otherwise contact, spreading the flame laterally as it stretches out. The combination of these effects maximizes the flane-to-log interface.

The preferred configuration of the base allows the device to be prepared in an accessible position in front of the grate. The device may then be slid into position upon runners extended from the base.

4 Claims, 4 Drawing Figures

FIREPLACE FIRE STARTER

BACKGROUND OF THE INVENTION

The current energy forecast has created a resurgence of interest in the use of home fireplaces to supplement residential heating. Growing numbers of people are utilizing their fireplaces in light of this renewed interest as well as the continued traditional appeal. Yet the ancient problem of initiating combustion remains.

One popular solution has been to position a gas jet under the log laden grate within the hearth. However, the solution is of limited availability to existing fireplaces that were not so equipped when constructed, and may be prohibited by expense of installation into new fireplaces, especially in otherwise all electric homes.

Perhaps the most prevalent alternative fire starting method is the use of a combination of kindling and newspaper. But this solution often produces only a collection of smoldering litter and a great deal of frustration. Further, the loosely packed newspaper often releases freely floating cinders light enough to respond to every wisp of air current. Such live cinders create multiple fire hazards, as they may float through the open hearth and into the dwelling, they may be carried up into the chimney and ignite flammable deposits there (a product of incomplete combustion from previous fires), or they may be carried through the chimney and released above the dwelling.

In addition, preparation for newspaper ignition requires frequent emptying of the accumulated ash in order to maintain enough room for the newspaper under the grate. Even when so prepared, the odds of newspaper ignition are such that one must ordinarily obtain, prepare, and store quantities of kindling as an intermediate to the desired ignition of full size fuel logs.

Other devices have been tried in this or related applications. First, it is not practical to light the logs within a containing device and then to place them into position in the fireplace. Thus, devices for igniting briquettes for outdoor barbecues (see Osterried, U.S. Pat. No. 4,094,649 and Clark, U.S. Pat. No. 3,957,455) may not readily be adapted for use in fireplaces. In addition, devices requiring several steps of preparation, such as disclosed by U.S. Pat. No. 380,606, which describes devices with which to saturate ash with liquid fuel and then to compress the ash into a solid form, prove clumsy and inconvenient. Further, devices which must be removed immediately after use and while very hot are undesirable. Thus an adaptation of the Quist device, see U.S. Pat. No. 1,461,496, is not appropriate. Finally, devices such as the Lowe lamp for starting fires, see U.S. Pat. No. 71,515, are inefficient as they affect only a small area of the prepared bed of logs.

SUMMARY OF THE INVENTION

In accordance with the present invention, there is provided a convenient, inexpensive, safe and effective device for facilitating the ignition of logs positioned on a grate within a fireplace.

Its design provides for an efficient and sustained application of flame from a readily flammable incindiary material in order to directly ignite fuel logs, thus obviating the need for prepared kindling and substantially lessening the liklihood of repeated unsuccessful attempts to initiate sustained combustion.

The igniting device of the invention comprises an elongated container proportioned to fit in a fireplace underneath the grate upon which the logs are positioned. The container opens at the top in a relatively narrow transverse slot that will receive a readily flammable liquid fuel into the container and will accommodae a wick with which to ignite the fuel. The slot also functions as a flame holder, since the flame resides there.

The walls of the container are made of a material that will conduct heat, initially from the flame then sustained by the ignited wick, to that portion of the container that holds the reservoir of fuel. The fuel itself is heated in this manner facilitating the vaporization and combustion of the fuel.

The interior surfaces of the upper sections of the container's walls are sloped inwardly and upwardly, and funnel the vaporized fuel into the container's open top where it burns. Further, the walls of the container defining the open slot at the top are positioned to contain and hold the flame and to receive and conduct some of the heat produced back toward the fuel reservoir, thereby vaporizing more fuel. Thus, a continuous feed of vaporized fuel is established that sustains combustion after the wick is consumed.

The natural convection of the fireplace creates a draft of air away from the front of the fireplace and up the chimney and the fire starting device of the invention exploits and enhances this natural draft. Once the logs begin to burn, the heat of the fire established in them becomes the main driving force for the draft.

The upper section of the forward (and windward) wall of the container slopes downwardly and outwardly from the opening at the top of the container. This upper exterior surface of the container cooperates with the surface formed by the bottom of the grate and its contents in order to effect an orderly restriction of the natural draft underneath the grate. This cooperation between the bottom surface of the grate and the forward surface of the device causes somewhat of a venturi effect,, increasing the velocity of the draft underneath the grate and above the container. Under this influence the draft becomes strong enough to pull a trail of the flame maintained at the top of the container underneath a greater depth of fuel logs than it would otherwise contact.

Under the effects of the venturi-influenced draft, the flame also speads laterally as it is pulled underneath the logs. The combination of these effects maximizes the area where the flame maintains contact with the bed of logs and thereby effectively and efficiently ignites the logs.

The bottom of the device is arranged to function in the environment expected in the bottom of a fireplace, that is to say, to be effective despite the presence of a layer of ashen residue. In ordinary operation the wick of the device is lit before the device is in position. Once the wick has been lit the device is slid from an accessible position in front of the grate to the operating position underneath it. Two features aid in this translation into a bed of ashes. First, that edge of the base supporting the container which leads in the translation into position slopes downwardly and outwardly from the container. So arranged, the base upon which the device slides serves to dig into any ashen residue and maintains contact for solid support upon the floor of the fireplace. Further, if the base similarily extends outwardly from the forward side of the device (as is preferred), the result is a broad and stable support for the container that does not tip over when slid into position.

The base also supports the bottom of the container at a position above the floor of the fireplace, providing a gap between their surfaces. In translation the lower section of the container's leading wall is slanted downwardly and inwardly toward the bottom of the container. This configuration serves to plough down and compact a substantial amount of the ash displaced rather than channelling the ash over the top and into the fuel reservoir during translation of the device into an operating position.

DESCRIPTION OF THE PREFERRED EMBODIMENTS

Figure 1:
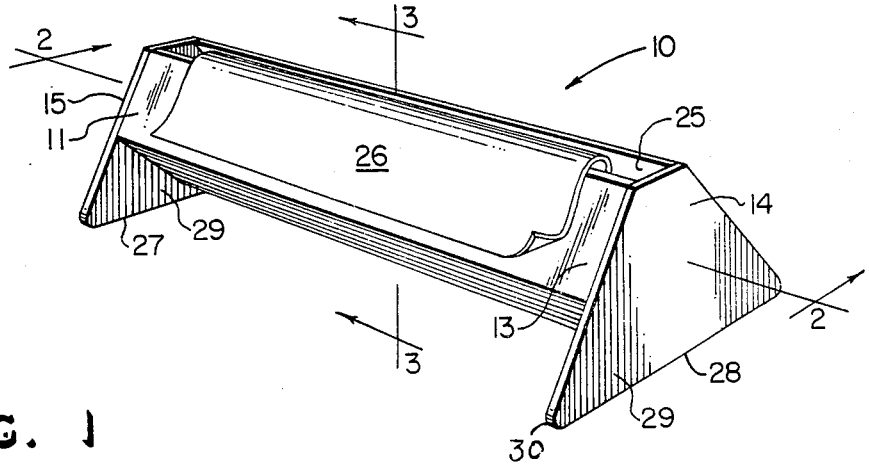
FIG. 1 is a perspective view of a fire starting apparatus constructed in accordance with the invention.
Figure 2:
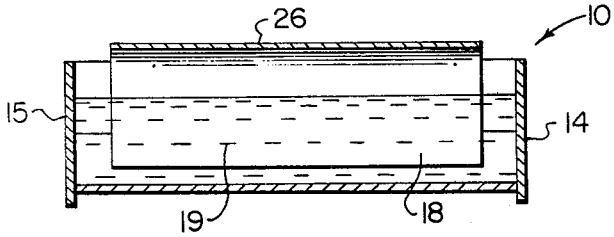
FIG. 2 is a cross sectional front elevational view, the section being taken on the line 2—2 of FIG. 1.
Figure 3:
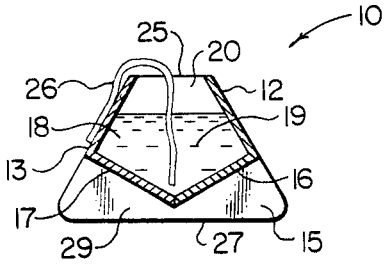
FIG. 3 is a cross sectional end elevational view, the section being taken on the line 3—3 of FIG. 1.
Figure 4:
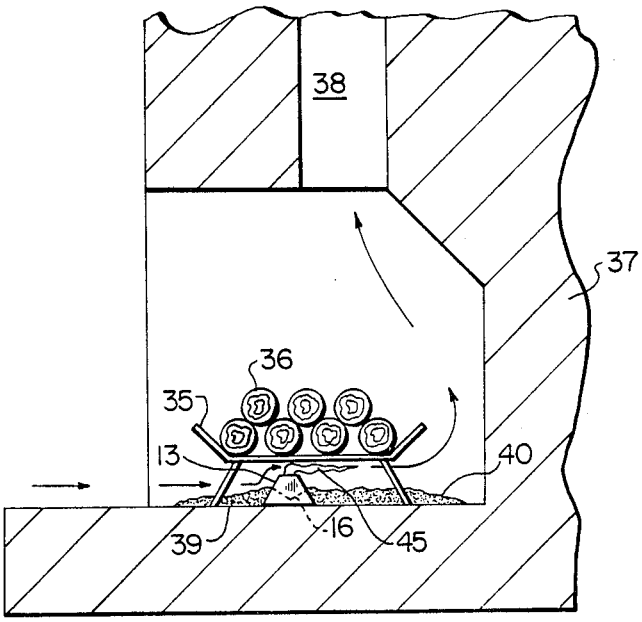
FIG. 4 is a cross sectional side elevational view of a fireplace and grate illustrating the apparatus of the invention in position with relation to the fireplace and accessories.

In the drawing, the apparatus of the invention is designated generally as 10. It includes an elongated container 11, having upper walls 12 and 13, end plates 14 and 15 and lower walls 16 and 17.

The container 11 defines a reservoir 18 for a readily flammable fuel 19. For reasons of safety, it is preferred that a liquid fuel with a fairly high flash point be employed, such as kerosine or another medium to heavy naphtha of the kind commonly used in fire starting products for charcoal grills and barbecue pits.

Upper walls 12 and 13 and end plates 14 and 15 define a relatively narrow transverse opening or slot 25 through which wick 26 passes from the exterior of container 11 into reservoir 18 and makes contact with the fuel 19.

End plates 14 and 15 extend downwardly and outwardly below the container to form a base 29 in order to support container 11 in a stable, and preferably elevated position.

The apparatus of the invention is designed to be used in a traditionally designed fireplace 37 with chimney 38 and floor 39. Resting on the floor is grate 35 which supports a bed of logs 36. Prior use of the fireplace has left a deposit of ashen residue 40 upon its floor.

For normal use, the fire starting device is prepared for operation at a position in front of the grate 35. In preparation, fuel is poured into container 11 through the open slot 25 at the top. The end of the wick 26 is then inserted into the slot and allowed to reach the fuel 19 within the reservoir 18. A variety of absorbent materials are suitable for wick purposes, but of particular convenience is the use of either ordinary facial or ordinary toilet tissue or other disposable paper products all of which are readily available in a home. The wick draws fuel by capillary attraction toward its other end which is draped across the front upper wall 13 (See FIG. 1). Once saturated, the wick is lit at its exterior end and the whole device 10 is then pushed into position beneath grate 35 upon which a bed of logs 36 have been placed.

The lower sections of end plates 14 and 15 form the support base 29 for container 11 and the bottom edges of the end plates are adapted to be runners 27 and 28 upon which the device may be easily slid into operating position. Those edges of the end plates 14 and 15 which lead in this translation (i.e. the back edges) are sloped downwardly and outwardly from the container. When positioning the device involves pushing it through ashen residue this configuration will tend to plough beneath the ash 40 and maintain a solid base upon the underlying floor 39. When both the leading and following edges are so sloped the configuration produces runners 27 and 28 of sufficient length to insure the stability of the container. Finally, the very tips 30 of the runners are rounded to facilitate sliding over irregularities in the floor 39 of the fireplace.

Also facilitating the translation of the device into position despite a bed of ashes 40 is the configuration of the back lower wall 16 of the container, which is the leading surface of the container during the sliding movement of the device into position under the grate. The lower wall 16 is sloped inwardly and downwardly. This slope serves to plough under and compress the displaced ash 40 rather than ploughing the ash over the open top 25 of the container and into the fuel reservoir 18.

The front upper wall 13 absorbes heat from the initial combustion as the wick 26 is consumed. The heat so produced is conducted throughout the container and there serves to heat the fuel 19 within the reservoir 18. The heated fuel vaporizes and rises through the throat 20 defined by the interior surfaces of upper walls 12 and 13. The throat culminates in the opening or slot 25 where the vaporized fuel is ignited by burning wick 26. Thus initiated, flame 45 is held at the slot and this combustion further heats the upper walls which in turn conduct the heat to the reservoir, vaporizing more fuel. In this manner combustion of the vapor fuel is supported and continues until the fuel is exhausted, though the wick has itself been consumed. It must be noted that the arrangement of upper walls 12 and 13' which define the throat and opening 25 in which the vapor fuel burns, is somewhat critical. A slot that is too wide will not function to hold the flame, while one that is unduly narrow produces too small a flame. One configuration that is particularly effective in sustaining and containing continuous combustion of the vapor fuel places upper walls 12 and 13 sloping inwardly and upwardly, each at approximately 60° to the horizontal and terminating at equal elevations, separated by approximately $\frac{3}{4}$ of an inch. Slot widths from about $\frac{1}{2}$ inches to about 1 inch have been found reasonably satisfactory.

In a properly designed fireplace 37, the heat of the fire establishes a natural draft of air away from the front of the fireplace and ultimately up the chimney 38. This convection draws air through the space bounded on the top by the surface defined by the bottom of the grate 35 and the bed of logs thereon 36. On the bottom this space is restricted by the placement of fire starting device 10.

The drawn air comes into contact with the windward or front side of the device 10. The upper wall 13 is inclined upwardly and inwardly and, in cooperation with the rough but relatively continuous horizontal surface formed by the grate and logs 36 thereon, creates somewhat of a venturi effect and restricts the flow of the draft in such a manner as to increase the velocity of the draft over the top of the device. The draft, possessed of this increased velocity, trails the flame 45 beneath a greater depth (from front to back in the fireplace) of the logs positioned upon the grate above than would otherwise be possible. Another effect of the venturi-stimulated draft has been noted: as the flame stretches to the rear, it also extends out to either side. The combination of these effects draws the flame across the underside of the logs and fans the flame out on either side along the trail in order to maximize the flame-to-log interface. It is at the flame-to-log interface that the flame from fire starting device 10 ignites the bed of logs 36.

Of course the operation of the venturi effect is responsive to the elevation of the slot 25 within which combustion is maintained in relation to the elevation of the ceiling surface defined by the 35 grate and logs 36. For standard log grates an elevation of about 2½ inches has been found appropriate. The preferred embodiment calls for a slot length of about 1/5 to ½ of the average log length. Thus a slot 8 inches long accommodates a range of commonly encountered log lengths. A longer slot and the corresponding flame will develop a draft around either end of the logs, thereby lessening the venturi effect and lessening the flame-to-log contact area. A longer slot length is also disadvantageous as it tends to initiate combustion at the ends of the logs, undesirably accelerating their consumption.

The flame 45 of fire starting device 10 extinquishes itself when vaporization and combustion have exhausted all of the liquid fuel in reservior 18.

The preferred embodiment is simply manufactured using two equal lengths of angle iron, one forming upper wall 13 and lower wall 17, the other forming upper wall 12 and lower wall 16, walls 16 and 17 being joined at the bottom of container 11, by welding for example. For further simplicity end plates 14 and 15 are bilaterally symmetrical as is the whole configuration making the "front" identical with the "back".

I claim:

1. Apparatus for starting a fire in a bed of logs positioned on a grate in a fireplace comprising:

an elongated container for flammable vaporizable liquid fuel proportioned to fit under said grate, said container being provided with an elongated opening at the top thereof giving access to the interior of said container for introduction of fuel thereto, the edges of said opening comprising means for anchoring the base of a flame at the opening;

said container having walls formed from a heat-conducting material for transferring heat from a flame established at said opening to a body of liquid fuel in said container to form a vaporization means to continuously vaporize fuel from said body and to deliver the fuel vapor so formed to the base of said flame to sustain it, whereby the fuel supply to said flame is sustainable in the absence of any wick once said vaporization means is brought to operating temperature;

said container being positionable beneath a fireplace grate with said elongated opening extending generally crosswise of the fireplace, and when so positioned, having an elongated wall extending downwardly from said opening toward the front of said fireplace to thereby establish with superjacent logs on said grate a restricted air flow passage between said opening and said logs which accelerates the flow of air therethrough to spread a flame established at said opening both longitudinally and laterally under said logs; and a base which is greater in transverse dimension than the remainder of the container to provide resistance to overturning of the container upon application of a moment tending toward overturning the container applied in the transverse direction; said base comprising two transverse runners, one adjacent each end of the container, said runners being proportioned to plough into a bed of ashes in said fireplace upon translation of the container into the fireplace beneath the grate.

2. Apparatus in accordance with claim 1 in which said runners have rounded corners for riding over irregularities in the floor of said fireplace.

3. Apparatus for starting a fire in a bed of logs positioned on a grate in a fireplace comprising:

an elongated container for flammable, vaporizedable, liquid fuel, proportioned to fit under said grate;

said containter comprising elongated walls and a pair of end plates abutting opposite ends of said elongated wall to form each end of said container;

the upper portions of said elongate walls and said end plates having uppermost edges which define a narrow elongated opening at the top of said container, whereby a fueled flame is retainable at said opening;

said elongate walls and said end plates having lower portions which define a reservoir for said liquid fuel;

said reservoir defining lower wall portions being connected to said elongated opening defining upper wall portions by at least one continuous heat conducting path, whereby heat from a flame at said opening is conducted to said liquid fuel within said reservoir to sustain vaporization of said fuel, thereby providing fuel to said flame in the absence of a wick once that flame has heated said fuel reservoir;

said container having upper interior portions of the elongated walls converging inwardly and upwardly toward said opening, whereby fuel vapors are collected and presented to said opening in a manner suitable for sustaining a flame;

said container being positionable beneath a fireplace grate with said elongate opening extending generally crosswise of the fireplace, and when so positioned having an exterior elongate wall portion extending downwardly from said opening toward the front of said fireplace, whereby said wall portion cooperates with the superjacent logs on said grate to form an orderly restriction of the air passage between said opening and said grate which has a venturi-like effect on the natural draft therebetween to spread a flame established at said opening both longitudinally and laterally under said logs, thereby maximizing the flame to long interface;

said container, when oriented in said position, having the lower portion of that elongate wall which faces toward the back of the fireplace, extending inwardly and downwardly;

said container being provided with a base which is greater in the transverse dimension that the remainder of the container, said base comprising a plurality of transverse runners, whereby said container is resistant to overturning moments; and each of said runners extending perpendicularly to the elongated opening, whereby the stability of the container is maximized at a minimum of resistance to sliding said container underneath said grate.

4. Apparatus in accordance with claim 3 in which:

the upper and lower wall portions of each of said elongate walls are each planar and said end plates are also planar;

said container and base being bilaterally symmetrical about said elongate opening;

each of said walls of said container being formed from heat conducting material and joined by thermally conductive means to any connecting wall;

said end plates having a trapezoidal configuration, transversing said elongate walls at right angles and extending downwardly from the container in order to provide said base, the lower edges of said end plates providing said runners.

* * * * *